United States Patent [19]

Christiansen

[11] 4,242,054

[45] Dec. 30, 1980

[54] HYDRAULIC UNIT

[76] Inventor: Kurt Christiansen, Schnabelweg 15, Wilen-Wollerau, Switzerland

[21] Appl. No.: 925,522

[22] Filed: Jul. 17, 1978

[51] Int. Cl.[3] ..... F04B 49/08

[52] U.S. Cl. ..... 417/218

[58] Field of Search ..... 417/218, 222; 60/445, 60/452; 91/52, 410

[56] References Cited

U.S. PATENT DOCUMENTS

| | | | |
|---|---|---|---|
| Re. 29,333 | 8/1977 | Pensa | 417/222 X |
| 2,338,021 | 12/1943 | Bennett | 91/52 X |
| 2,472,104 | 6/1949 | Grant et al. | 417/218 |
| 2,699,224 | 1/1955 | Schmitz | 91/52 X |
| 3,669,570 | 6/1972 | Himmler | 417/222 |

FOREIGN PATENT DOCUMENTS

| | | | |
|---|---|---|---|
| 2360186 | 6/1975 | Fed. Rep. of Germany | 417/218 |

*Primary Examiner*—Carlton R. Croyle
*Assistant Examiner*—Edward Look
*Attorney, Agent, or Firm*—Roylance, Abrams, Berdo & Farley

[57] ABSTRACT

A hydraulic control device to vary the displacement of a hydraulic piston unit, such as pump or motor, in function of the operating pressure, is provided with a pilot-operated servo piston. The pilot system comprises a sensing piston responsive to the operating pressure actuating a pilot piston and a force exerting member acting at an angle to the direction of movement of the sensing piston, the sensing piston and force exerting member acting on a movable bearing. The pilot piston is hydraulically and the movable bearing mechanically, e.g. by a coupling lever, connected to the main piston.

11 Claims, 5 Drawing Figures

HYDRAULIC UNIT

BACKGROUND OF THE INVENTION

The present invention relates to hydraulic control devices.

The invention is particularly concerned with a hydraulic control device to vary the displacement of a hydraulic piston unit, such as pump or motor. Control devices have been proposed for keeping the torque constant, and such a construction is, for example, illustrated in U.S. Pat. No. 3,510,231 and Swiss Patent Specification No. 469,908. The arrangement involves the use of three springs. Such constructions can only be set within a limited range of torques, unless the springs are changed. Furthermore, the torque must initially be set on a test stand and the construction of such a hydraulic unit is relatively expensive since the unit is rather bulky.

SUMMARY OF THE INVENTION

It is now proposed, according to the present invention, to provide a hydraulic control device to vary the displacement of a hydraulic piston unit, pump or motor, having a servo piston operated by a pilot system, said system comprising a sensing piston responsive to the operating pressure which is actuating a pilot piston, and a force exerting member acting at an angle to the direction of movement of the sensing piston, the sensing piston and force exerting member acting on a movable bearing, said pilot piston being coupled hydraulically and said movable bearing being coupled mechanically to the servo piston to move the bearing as a function of the position of the servo piston.

Such an arrangement can be of simple construction, simple to set and can be made relatively small.

An embodiment of the invention is shown with accompanying drawings and described below.

BRIEF DESCRIPTION OF THE DRAWINGS

There is shown.

DESCRIPTION OF THE PREFERRED EMBODIMENT

Figures 1, 2, 3, 4:
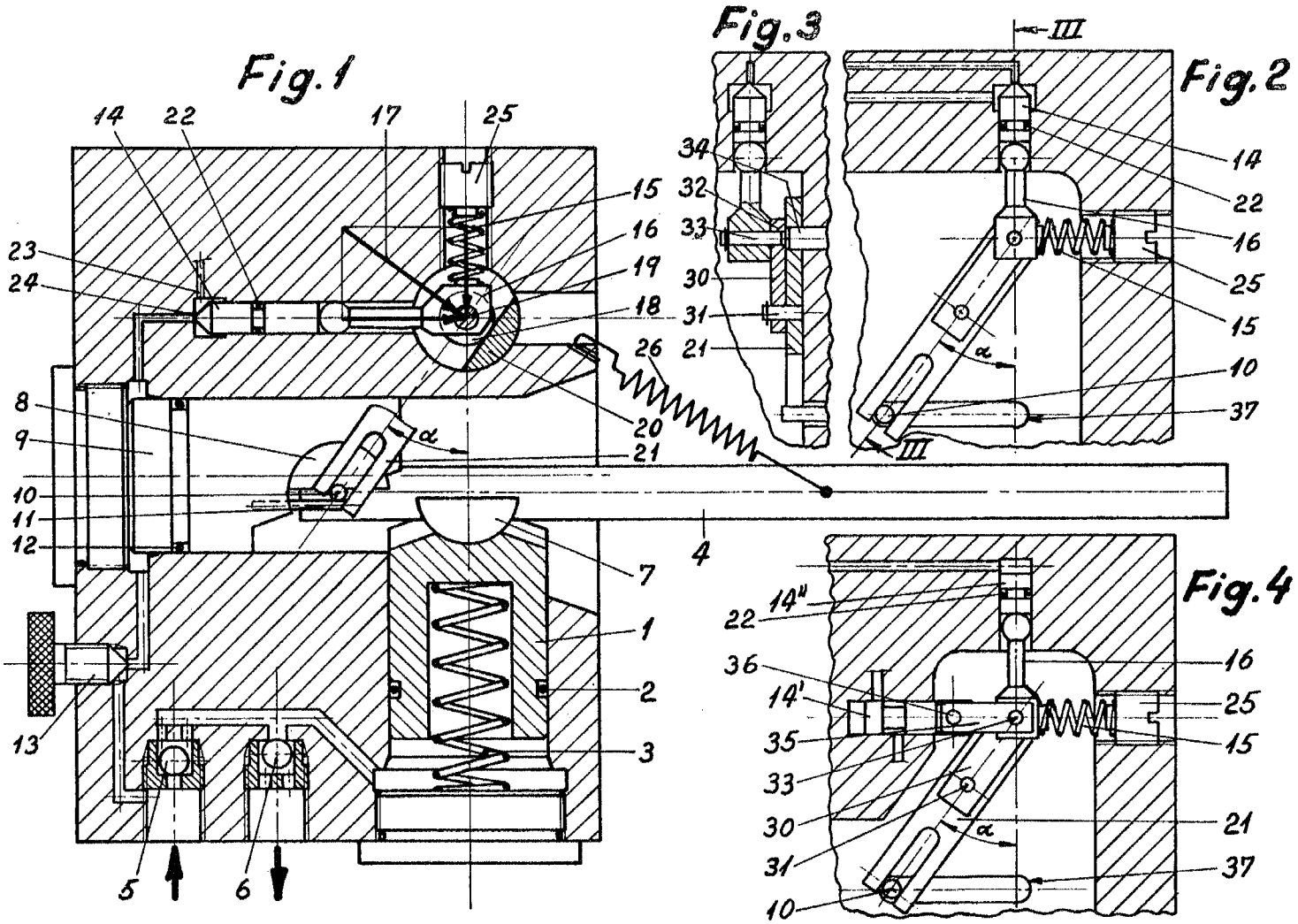
FIG. 1 shows a cross-section through one embodiment of a hydraulic control device.
FIG. 2 shows a section through a modified construction of a hydraulic control device.
FIG. 3 shows a section taken along the line III—III of FIG. 2.
FIG. 4 shows a section through a further modified construction of a hydraulic control device.

Referring first to FIG. 1, the hydraulic control device illustrated therein is arranged in connection with a hand operated hydraulic pump. However, the hydraulic control device according to the present invention can also be employed in any other arrangement which is to be regulated.

The hydraulic pump shown in FIG. 1 includes an operating piston 1 which is reciprocable in a cylinder and is provided with an 0-ring seal 2. The piston 1 is urged upwardly by a spring 3 against a cradle 7 which can be urged manually downwardly by an operating level 4. The flow of pressure medium to and from the cylinder associated with the main piston 1 is controlled by non-return inlet and outlet valves 5 and 6 respectively.

The lever 4 is pivotally mounted in a notch formed in a cradle 8, the shaft 10 being pressed into this notch by two leaf springs 11. Axial movement of the servo piston 9 causes the lever ratio of the lever 4 to be varied since it moves the pivot point 10 of the lever 4 relative to the cradle 7 and thus varying the stroke or displacement of the piston 1. The servo piston 9 is sealed with an O-ring seal 12.

A pilot and sensing piston 14 is axially reciprocable in a cylinder and fluid at the operating pressure of the piston 1 is fed to the left hand end of the sensing piston 14 via an inlet line 23. A force exerting spring 15 is capable of urging a member 16 at right angles to the direction of movement of the pilot and sensing piston 14. A rod having a ball end is connected to the member 16, the ball end engaging on the right hand end of the piston 14. The member 16 carries a roller 18 which is rotatable about a shaft 19 and bears against a rotatable bearing element 20.

The bearing element 20 is connected via a mechanical coupling lever 21, having a slot at its lower end, to the pivot point 10 of the lever 4.

The left hand end of the pilot and sensing piston 14 is connected via a line 24 to behind the servo piston 9. The force exerted by the spring member 15 can be controlled by adjustment of the adjusting screw 25. The lever 4 is provided with a return tension spring 26.

In operation, when the lever 4 is pivoted manually about the pivot point 10, the main piston 1 is caused to reciprocate and this produces an outlet pressure. This outlet pressure is fed also to the line 23. This outlet pressure, therefore, tends to urge the sensing piston 14 to the right as shown in the drawing. The force thus produced, together with the force of the spring 15, produces a resultant force 17. If the piston 14 is in fact moved to the right as a result of this resultant force, the fluid pressure at the operating pressure of the main piston and cylinder 1 appearing at line 23 is transmitted via line 24 to urge the servo piston 9 to the right. This will have the effect of moving the mechanical coupling lever 21 which in turn will rotate the rotatable bearing 20 which will cause a reduction in the angle $\alpha$ so that the resultant reaction force to the force 17 will tend to close the line 24. This will result in an equilibrium being achieved which is determined as a function of the spring pressure adjustable by means of the screw 25. Therefore the moment which it is necessary to exert on the lever 4 can be controlled to a predetermined value by simple adjustment of the single adjustor 25. When the pressure reduces again, the hydraulic fluid will exhaust past the adjustable bleed valve 13 to be taken up again through the inlet 5.

FIGS. 2 and 3 show a generally similar construction of a hydraulic control device in which like parts have been indicated by like reference numerals. A lever 30 is pivotally mounted at 31 on the mechanical coupling 21 and this carries, via a pivot 33 near the free end of the lever 30 an element having a ball end bearing against the pilot and sensing piston 14. The mechanical coupling lever 21 is itself pivoted at 34 to the housing.

The construction of a hydraulic control device illustrated in FIG. 4 is generally similar to that of FIG. 3 except that in this arrangement the pilot valve 14′ is aligned with the spring 15 and is coupled via a lever 35 to a separate sensing valve 14″.

In the embodiments of FIGS. 1—3, the pilot piston is formed as a unitary part of the sensing piston. The piston of the piston 14 forms the pilot piston which controls the flow of fluid pressure to the servo piston 9. The conical surface around this point of piston 14 forms the sensing piston. Such arrangement differs from that of the embodiment of FIG. 4 wherein the sensing piston 14'' and the pilot piston 14' are not integral, but are connected by a mechanical linkage pivotally coupled thereto.

Figure 5:
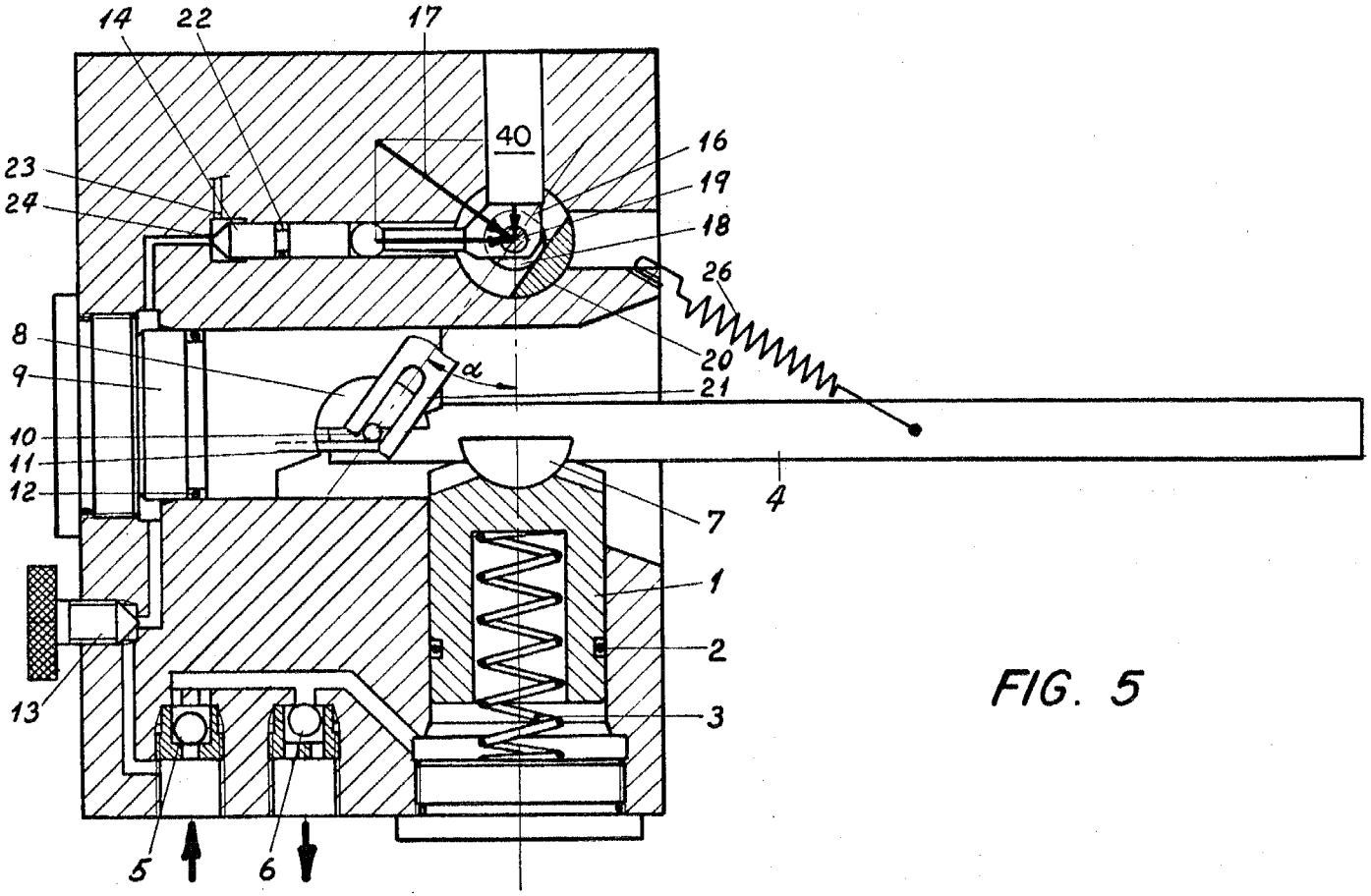
FIG. 5 shows a cross section through a still further modified construction of a hydraulic control device.

FIG. 5 illustrates an alternative embodiment of the present invention. The embodiment of FIG. 5 is similar to that of FIG. 1 except that in this embodiment, the spring 15 and the screw 25 have been replaced by a fluid actuated force exerting mechanism 40. This mechanism is graphically illustrated in FIG. 1 and may be either hydraulically or pneumatically operated.

The various forms of hydraulic control devices according to the present invention are very compact, very simple and easily adjustable, because they can be adjusted merely by using the screw 25 and because the same spring can be used for the entire setting range. If the device is to keep the torque of the lever 4 constant, the torque is proportional to the spring force; consequently rotation of the adjustment screw 25 produces a precisely defined change in the torque; consequently, changing the setting during operation is easily possible. The further advantage is that a remote controlled setting is possible and for this purpose the spring may be replaced by a piston so that the torque becomes proportional to the pressure acting on the piston.

The control device can also be used in conjunction with another actuating device, as a displacement limiter for displacements which are smaller or greater than the set limiting value. The displacement limiter can also be constructed to be double acting, i.e. the suction and pressure sides of the unit can alternate.

What is claimed is:

1. A hydraulic control device for maintaining the product of the operation pressure and the displacement of a displacement pump constant, comprising servo piston means for controlling the displacement of the pump, and a pilot system for controlling movement of said servo piston means, said pilot system comprising sensing piston means for sensing the operating pressure of the pump, said sensing piston means being movable along a sensing piston axis in response to the operating pressure, pilot piston means operatively coupled to said sensing piston means and hydraulically coupled to said servo piston means for controlling the application of fluid pressure to said servo piston means, force exerting means for supplying force along a force axis, said force axis being nonlinear with said sensing piston axis, and a movable bearing acted on by forces generated by said sensing piston means and said force exerting means at the intersection of said sensing piston axis and said force axis, said bearing being coupled mechanically to said servo piston means by a coupling lever to move said bearing as a function of the position of said servo piston means.

2. A hydraulic control device according to claim 1, wherein said movable bearing comprises a rotating bearing pin which is rotated by said coupling lever, said bearing has bearing face, and said sensing piston means and said force exerting means are supported on said bearing face by rollers.

3. A hydraulic control device according to claim 1, wherein said movable bearing comprises a tilting lever pivotally coupled to said coupling lever.

4. A hydraulic control device according to claim 1, wherein said sensing piston axis and said force axis are substantially perpendicular.

5. A hydraulic control device according to claim 1, wherein said force exerting means comprises a spring.

6. A hydraulic control device according to claim 1, wherein said coupling lever is fixedly secured to said movable bearing and is tilted by said servo piston means.

7. A hydraulic control device according to claim 1, wherein said sensing piston means and said pilot piston means are coupled by a mechanical linkage pivotally coupled thereto.

8. A hydraulic control device according to claim 1, further comprises a hand-operated pump actuated by an operating lever, said operating lever being mounted on a cradle and carried by said servo piston means.

9. A hydraulic control device according to claim 1, wherein said force exerting means has adjustment means for varying the force generated thereby.

10. A hydraulic control device according to claim 1, wherein said adjustment means comprises a threaded member.

11. A hydraulic control device according to claim 10, wherein said force exerting means is fluid actuated.

* * * * *